US005909859A

United States Patent [19]

Janicki

[11] Patent Number: 5,909,859

[45] Date of Patent: Jun. 8, 1999

[54] MULTI-ROTOR KITE GLIDER

[76] Inventor: Stephen J. Janicki, 207 Railroad St. P.O. Box 208, Wakarusa, Ind. 46573

[21] Appl. No.: 08/812,684

[22] Filed: Mar. 6, 1997

Related U.S. Application Data

[ 60] Provisional application No. 60/014,428, Mar. 28, 1996.

[51] Int. Cl.[6] ..... B64C 31/06

[52] U.S. Cl. ..... 244/153 A; 244/153 R

[58] Field of Search ..... 244/9, 27, 153 A, 244/153 R, 58

[56] References Cited

U.S. PATENT DOCUMENTS

| | | | |
|---|---|---|---|
| 272,926 | 3/1883 | Guinn | D21/91 |
| 987,380 | 3/1911 | Kuenzel | 244/27 |
| 1,051,659 | 1/1913 | Ames . | |
| 1,321,722 | 11/1919 | Crowley | 244/27 |
| 1,927,538 | 9/1933 | Zaparka . | |
| 2,107,808 | 2/1938 | Van Itterson . | |
| 2,334,286 | 11/1943 | Quickel | 244/9 |
| 2,442,846 | 6/1948 | Dunn . | |
| 3,355,129 | 11/1967 | Kinsey | 244/155 |
| 4,012,017 | 3/1977 | Springston | 244/153 |
| 4,051,622 | 10/1977 | Sharp | 46/74 |
| 4,084,102 | 4/1978 | Fry | 290/55 |
| 4,113,205 | 9/1978 | Shaw | 244/20 |
| 4,127,247 | 11/1978 | Strasilla | 244/152 |
| 4,243,190 | 1/1981 | Sams | 244/153 A |
| 4,296,704 | 10/1981 | Bridge | 114/103 |
| 4,366,386 | 12/1982 | Hanson | 290/44 |
| 4,401,284 | 8/1983 | Austin | 244/21 |
| 4,452,007 | 6/1984 | Martin | 446/45 |
| 4,465,008 | 8/1984 | Ligget | 114/39 |
| 4,497,272 | 2/1985 | Veazy | 114/103 |
| 4,572,962 | 2/1986 | Shepard | 290/55 |
| 4,582,013 | 4/1986 | Holland | 114/102 |
| 4,596,367 | 6/1986 | Wittwer | 244/39 |
| 4,602,584 | 7/1986 | North | 114/39 |
| 4,606,518 | 8/1986 | Jeffrey | 244/153 A |

(List continued on next page.)

FOREIGN PATENT DOCUMENTS

| | | | |
|---|---|---|---|
| 2208671 | 8/1973 | Germany | 244/153 A |
| 2558434A1 | 7/1976 | Germany | 244/153 A |
| 197503 | 2/1978 | United Kingdom . | |
| 197804 | 4/1978 | United Kingdom | 244/153 A |
| 2232360 | 12/1990 | United Kingdom | 244/153 A |

OTHER PUBLICATIONS

Sling shot by Steve Janicki, 1988, Janicki.
Invention Disclosure, 1995, Janicki.
The wind book by Jack Park, 1920's, Savonius S Rotor, p. 74.
Popular Science Aug. 1983, 1852, Magnus Gustars Effect, pp. 60–63.
Popular Science, Aug. 1983, Hansens Windmill, pp. 60–63.
Popular Science, 1852, Flettners' Rotor, pp. 70–73.
Jan. 1984, Bergeson's Spin Sail, pp. 70–73.
Analysis of Sail Assist for Oceanographic Ships, 1982, Bergeson, p. 50.

*Primary Examiner*—Charles T. Jordan
*Assistant Examiner*—Tren Dinh
*Attorney, Agent, or Firm*—R. Tracy Crump

[57] ABSTRACT

A kite employing a controllable transmission between two specialized types of rotor assemblies. The torque rotor assembly, is designed to rotate when placed in a stream of wind, collecting power from the wind in the form of lift and torque. The lift rotor assembly, transfers torque energy from the torque rotor into lift, through the system of power transfer. Torque energy from the torque rotor assembly is used to power the control system for the transmission, the control system for a remote mechanism to steer the kite, and power for other devices and remote functions. This invention is dedicated to harnessing and utilizing wind power, both torque and lift, by providing a metered and therefore controllable amount of lift through the variability of the transmission, in a vector along the kite line. The usefulness of this vector of lift is enhanced because, it can be altered through the steering system while retaining the reeling ease of a single string, and can provide power for remote functions.

7 Claims, 4 Drawing Sheets

U.S. PATENT DOCUMENTS

| | | | |
|---|---|---|---|
| 4,685,642 | 8/1987 | Schloss | 244/153 A |
| 4,708,078 | 11/1987 | Legaignoux | 114/102 |
| 4,722,497 | 2/1988 | Stanford | 244/152 |
| 4,790,498 | 12/1988 | Daniel | 244/153 A |
| 4,799,914 | 1/1989 | Hutchinson . | |
| 4,848,704 | 7/1989 | Sams | 244/153 A |
| 5,064,148 | 11/1991 | Kunze | 244/153 A |
| 5,149,020 | 9/1992 | Rundle | 244/153 A |
| 5,333,996 | 8/1994 | Bergstein | 416/197 A |
| 5,335,886 | 8/1994 | Greenhalgh | 244/213 |
| 5,352,144 | 10/1994 | Kuhn | 446/176 |
| 5,366,182 | 11/1994 | Roeseler | 244/155 R |
| 5,598,988 | 2/1997 | Bakur | 244/153 A |

MULTI-ROTOR KITE GLIDER

This patent application claims domestic priority based on my earlier filed provisional patent application, Ser. No. 60/014428 filed Mar. 28, 1996.

FIELD OF INVENTION

This invention relates to kites, specifically to such kites which are use to accomplish controlled feats of work using lift.

DESCRIPTION OF PRIOR ART

There are two main problems in attempting to harness wind power. First, the speed of the wind is ever changing. Second, there is a direct and geometrical relationship between the speed of the wind and the resulting levels of power. In other words, relatively small changes in wind velocities result in very significant changes in power levels. Kites have been used to do practical task throughout history. Kite designers in the past have attempted to adjust for changes in the wind primarily by manipulating the kite strength, size, and/or the angle of sail in relation to the wind. Automatic governors have been use to adjust kite angles during flight, to compensate for wind changes. Of course the velocity of the wind in relation to the kite can be changed by simply moving the ground point. Winches or reeling devices can achieve the same end. Unfortunately, none these methods of control have been adequate to make the kite a truly useful device for performing work, compared to other modern alternatives of power.

Marine propulsion is perhaps the area with the most potential to extract power from lift. The Veazy Patent details a "mastless sail system" for "boats and ships." The inventor details and claims A "mastless sail system" that utilizes "static and dynamic lift" (claim 1), even specifically "a steerable parafoil" (claim 4). The diagrams are extensive and show vision on the part of the inventor. His clear and elaborate diagrams however lack any sign of a significant awareness of the importance of high velocity sails or claims devoted to the kind of complex velocity controls that would be needed therein. Since he was clearly not aware of the importance high velocity generation, the patent falls short covering or anticipating this most important component.

The advent of the "stunt kite" occurred in the 1960's. The stunt kite is a kite that can be maneuvered in the sky. This is accomplished by manipulating the length of its two control strings in relation to each other. It has long been known that the position of a kite can be adjusted in flight in a variety of ways, such as by a second string positioned to tilt the kite, or by a rudder. As stunt kiting became popular and more widely practiced, it exposed a major revelation in the field. Material and design advances produced high speed kites that can develop a kite velocity 3 to 4 times faster than the actual wind speed. The importance of kite velocity has become apparent. This component of velocity produces tremendous power at a given sail area. Control of this power can be achieved by controlling the movement of the kite. But adequate systems for control of movement in kites does not yet exist.

Multi-string formats are in adequate because they dictate that all the string must be paid out prior to launch. This greatly limits the application of the possible power by eliminating use in applications where adequate space is unavailable. Dual string reels and winches have been designed with some success. The Kinsey U.S. Pat. No. 3,355,129 details a system to reel in and out two lines simultaneously while providing means for differentiation of line length for kite control. Bill Roeseler elaborates on this theme in U.S. Pat. No. 5,366,182. He has patented and marketed a similar reeling system, for use over water, which allow for a dual string stunt kite to be launched and controlled while the lines are being let out. It can also retrieve both kite lines simultaneously in the event of the kite going down in the water. These systems overcome the launch/retrieval problem enough to create a marketable leisure product. However, control of a stunt kite at present can only be achieved though the intensive and focused effort of a human flyer. Only the most skilled kite pilots can control a high velocity stunt kite while maintaining the control of the resulting power. Because of this difficulty slower kites are generally used to help pilots maintain control. The big advantage of using a kite is that it's movement is not dictated by the object or craft it is powering, because it is not statically attached. If the kite itself is not capable of exceeding the speed and acceleration of the craft it is powering than it's velocity power potential is lost, and with it that component of control. While the Roeseler system was a good first step, it only marginally succeeds as a sport vehicle power system and is- inadequate as a utility power device.

A kite that creates lift by generating rotational velocity is called a gyro kite. According to the book Kites by David Pelham, a gyro kite/glider was used to lift observers during W.W.II. It employed a vertical shaft rotor configuration and long narrow blades familiar in the modem helicopter. A kite of this type is detailed in U.S. Pat. No. 5,149,020 Oct. 26, 1991 by Gary L. Hooten. This configuration would be very inefficient at collecting power from the wind under different string angles while transferring lift along the vector of the string. Perpendicular horizontal axis rotor kites overcome this problem. The patents noted here are just a few of the total in this category of kite: Jeffrey Daniel U.S. Pat. Nos. 4,790,498 Dec. 13, 1986 and 4,606,518 Aug. 19, 1988 Space invader; Coy F. Harris stunt Rotary, U.S. Pat. No. 4,078,746 Mar. 14, 1978; Lyle Williams Mar. 15, 1977 U.S. Pat. No. 4,012,017 gyro kite twin stabilizer. They detail simple single rotor gyro kites with variations in materials construction, and stabilizer disc placement.

Kenneth Sams of London, England has two patents 4243190 Jan. 6, 1981 and Patent No. 4848704 Jul. 18, 1989. He anticipates the importance and details the usefulness of a gyro kite with the ability to control lift by manipulating rotational velocity using friction inhibitors and rotors capable of changing shape and aspect ratio to control lift. He sights a wide variety of applications including visual effects for signs, kites, parachutes, hang gliders, airplanes and sails for sailboats. However, none of the horizontal axis gyro kite patents, including the Sam's Patents anticipate or claim the means necessary to generate and or control high speed velocity.

This type of kite generates lift in accordance with the principles of the magnus effect. Lift is dictated by the cylindrical area formed by the rotating blades and the speed at which this surface is moving. None of the rotor kites described in these prior patents can produce a rotational velocity that is not close to a 1 to 1 ratio to the speed of the wind. In other words, the speed of the surface area of the cylinder formed by the tips of the spinning rotors will be approximately equal to the wind speed. The mechanics of the Sam's rotor kites can change the aspect ratio and therefore the rpm of the rotational velocity. But this does not significantly change surface speed or tip speed ratio. It simply means that at a given tip speed, a smaller diameter cylinder will complete more revolutions in a given length of time. The Sam's kites start with a maximum rotational velocity of around wind speed at the outer diameter, and then changes the area by changing aspect ratio or angle of attack. He alludes to a breaking system that could be used to slow or stop rotation and there by achieving true velocity manipulations, though be it in a negative direction. But such a system is problematic because of the torque forces that would occur and work against the brake. In addition he does describe a multi-rotor powered device. This could potentially be a high velocity rotary device. It is however put forth as a novelty or toy, and specifically uses identical rotors. This does not anticipate or create a situation of infringement with my invention.

OBJECTS AND ADVANTAGES

Accordingly, several advantages of my invention are:

(a) To provide a kite that harvests wind power through lift despite the inherent difficulties therein, by taking advantage of both torque and lift forces resulting from wind power.

(b) To provide such a kite that is high velocity in nature.

(c) To provide such a kite that can be operated as a controllable high velocity kite system on a single string.

(d) To provide such a kite that is gyroscopic in nature.

Further objects and advantages are (a) To provide a kite that is a useful device for performing work in a wide variety of applications.

(b) To provide such a kite that is elegant, novel and exciting in flight.

(c) To provide such a kite that is electronic in nature.

(d) To provide such a kite that is simple to manufacture.

Still further objects and advantages will become apparent from a consideration of the ensuing description and diagrammatic drawings, of an embodiment which is designed to serve as an example of this invention as simply and clearly as possible.

DRAWING FIGURES

Figure 1:
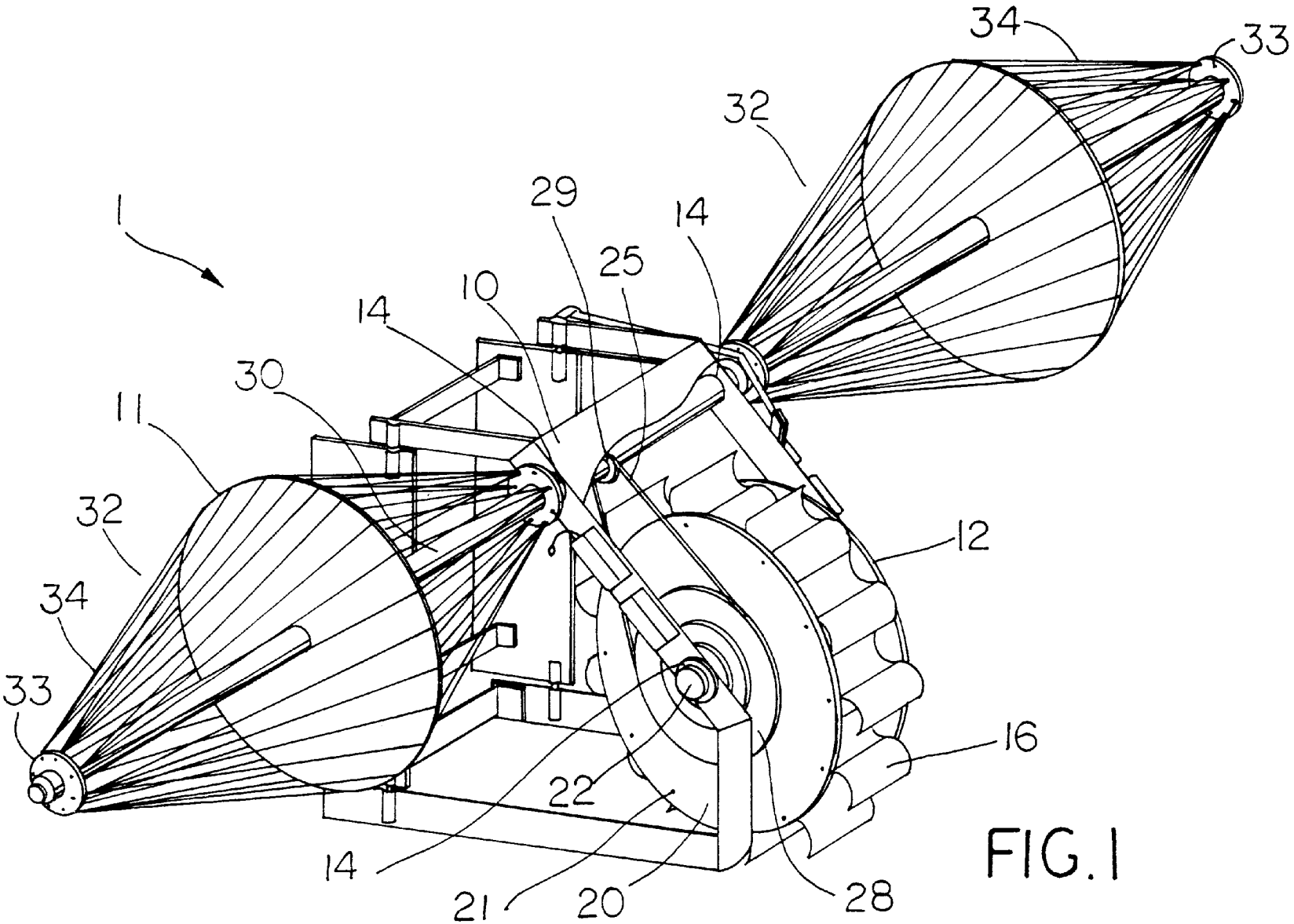
FIG. 1 is an isometric drawing showing the left side of the invention.

REFERENCE NUMERALS IN DRAWINGS frame 10
lift rotor centers 11
torque rotor assembly 12
bearings 14
blades 16
torque rotor sides 20
blade shafts 21
torque rotor shaft 22
belts 25
generator 26
servos 27
clutch 28
lift rotor pulleys 29
lift rotor shaft 30
lift rotor assembly 32
connector washers 33
lift rotor strings 34
rudders 40

DESCRIPTION

FIGS. 1 to 6

Figure 2:
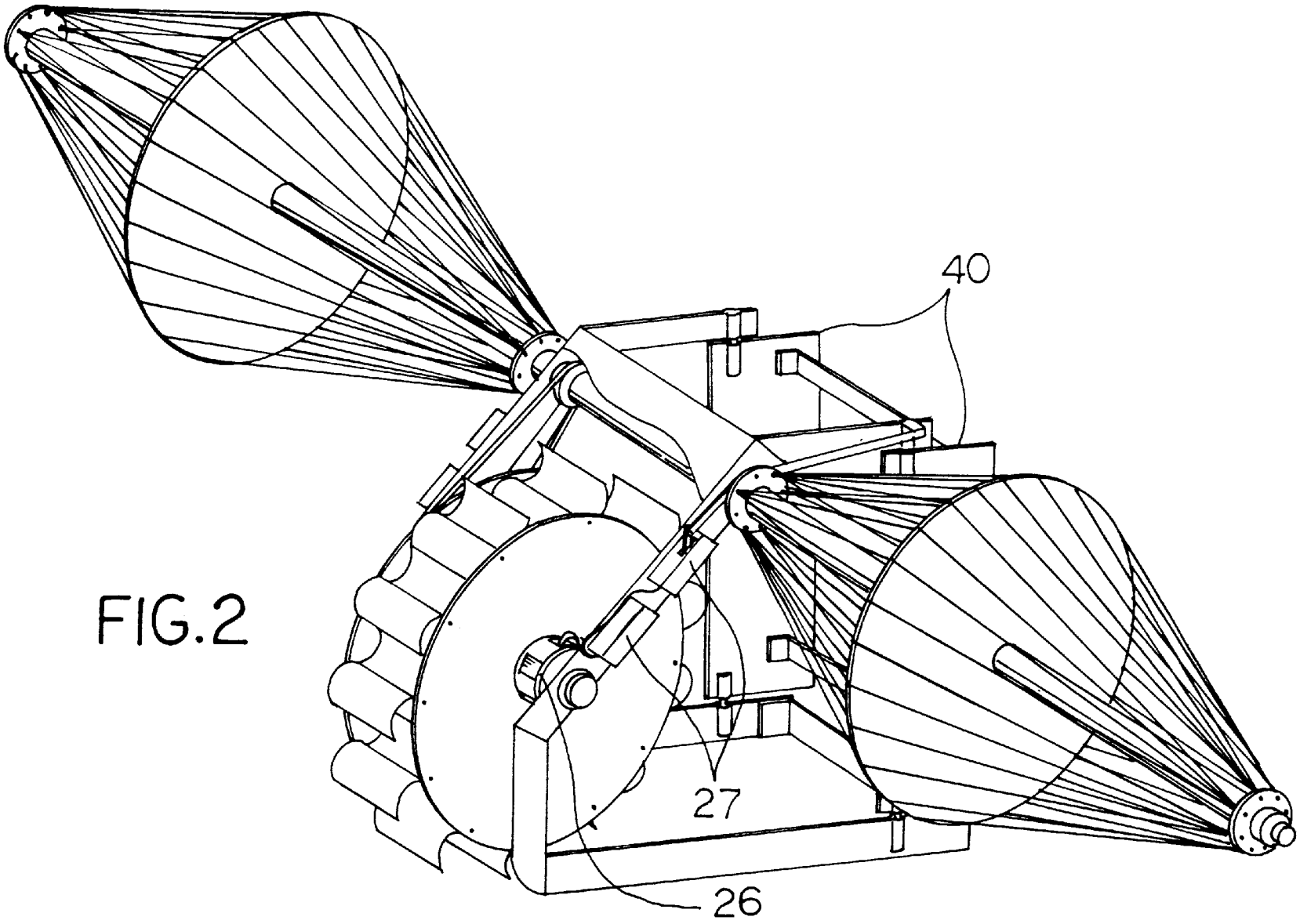
FIG. 2 is an isometric drawing showing the right side of the invention.

My invention, the Multi-Rotor Kite Glider 1 known as glider 1 shown in FIGS. 1 and 2, a frame 10 is formed out of two side structures flanking the torque rotor assembly 22. The frame is fabricated in a hard and rigid yet light weight material such as aluminum or ABS plastic. The bottom of the sides of frame 10 form runners which would support it on the ground. Floats could be added for support in water.

Bearings 14 are fitted into the frame 10 along the top of the sides to allow two shafts to pass through. One pair for the torque rotor shaft 22, the other pair for the lift rotor shaft 30. Between the bearings on both sides of the legs of the frame 10, servos 27 are mounted. Rudders 40 are attached at the back of each side of frame 10 at the top and bottom.

The torque rotor assembly is made from two torque rotor sides 20. They are mounted securely to torque rotor shaft 22, and constructed out of a strong rigid plastic, or aluminum. Blade shafts 21 run between the two torque rotor sides 20 to form a structure in which the discs are held tightly in relation to each other. These shafts are formed out of plastic, metal, taught strings, or a combination of these materials. Blades 16 would be mounted freely on blade shafts 21. The blades would be made of a light weight and rigid material such as plastic or aluminum.

Figure 4:
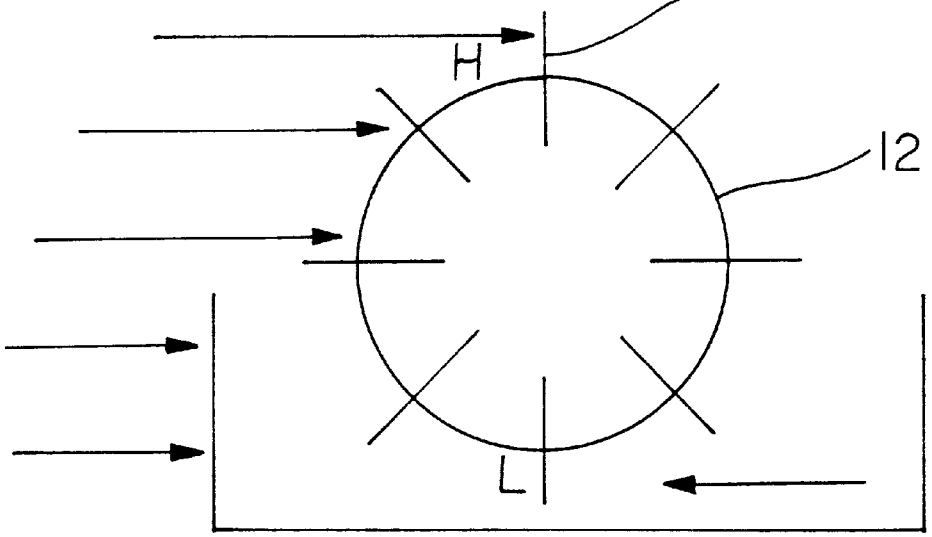
FIG. 4 is a diagrammatic side view of an alternative torque rotor assembly configuration.
Figure 3:
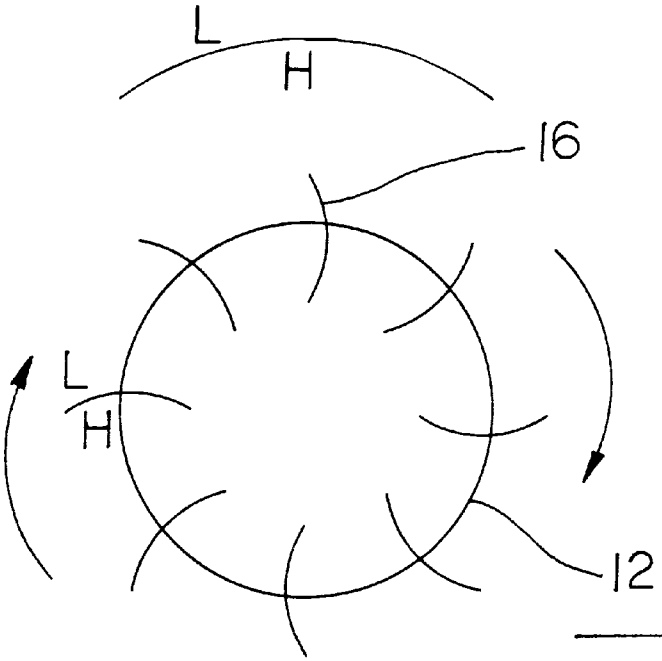
FIG. 3 is a diagrammatic side view of an alternative torque rotor assembly configurations.

Alternative torque rotor assemblies are shown in FIGS. 3 and 4. Unlike the free spinning blades in the preferred embodiment in FIG. 1, in the alternative torque rotor assemblies, the lightweight metal or plastic blades 16 would be rigidly mounted between the discs.

On the very edge of torque rotor shaft 22, on the left side, a generator 26 is shown on FIG. 2. Shown FIG. 1 the clutch 28 whose housing is made from a material such as wood, metal or plastic and is formed in the shape of a pulley. Belts 25 made of a material such as rubber or leather run from clutch 28's pulley shaped housing to the lift rotor pulley 29. The lift rotor pulley 29 is mounted securely to lift rotor shaft 30. The lift rotor shaft 30 runs through frame 10 at bearings 14.

Cone shaped lift rotor assemblies 32 are formed on both sides of lift rotor shaft 30. Lift rotor centers 11 are formed out of some lightweight yet rigid material. They are connected securely to the lift rotor shaft 30 at their center points. Lift rotor strings 34 run over and are mounted at the edge of lift rotor centers 11. They are secured at both ends by connector washers 33 and tensioned to correct any warping of shaft 30. Within this mode of construction strings could be connected at differing lengths off center, along the shaft. In this way some strings would be configured closer to center to increase strength. Fiberglass rods fitted with connectors or sheathed in fabric could then form lift rotor centers 11, analogous to the manner bicycle spokes suspend bicycle rims.

Figure 5:
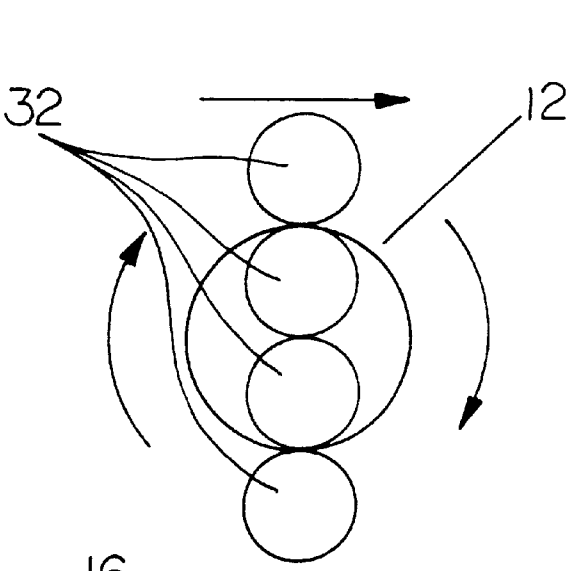
FIG. 5 is a diagrammatic side view of an alternative lift rotor assembly configuration.
Figure 6:
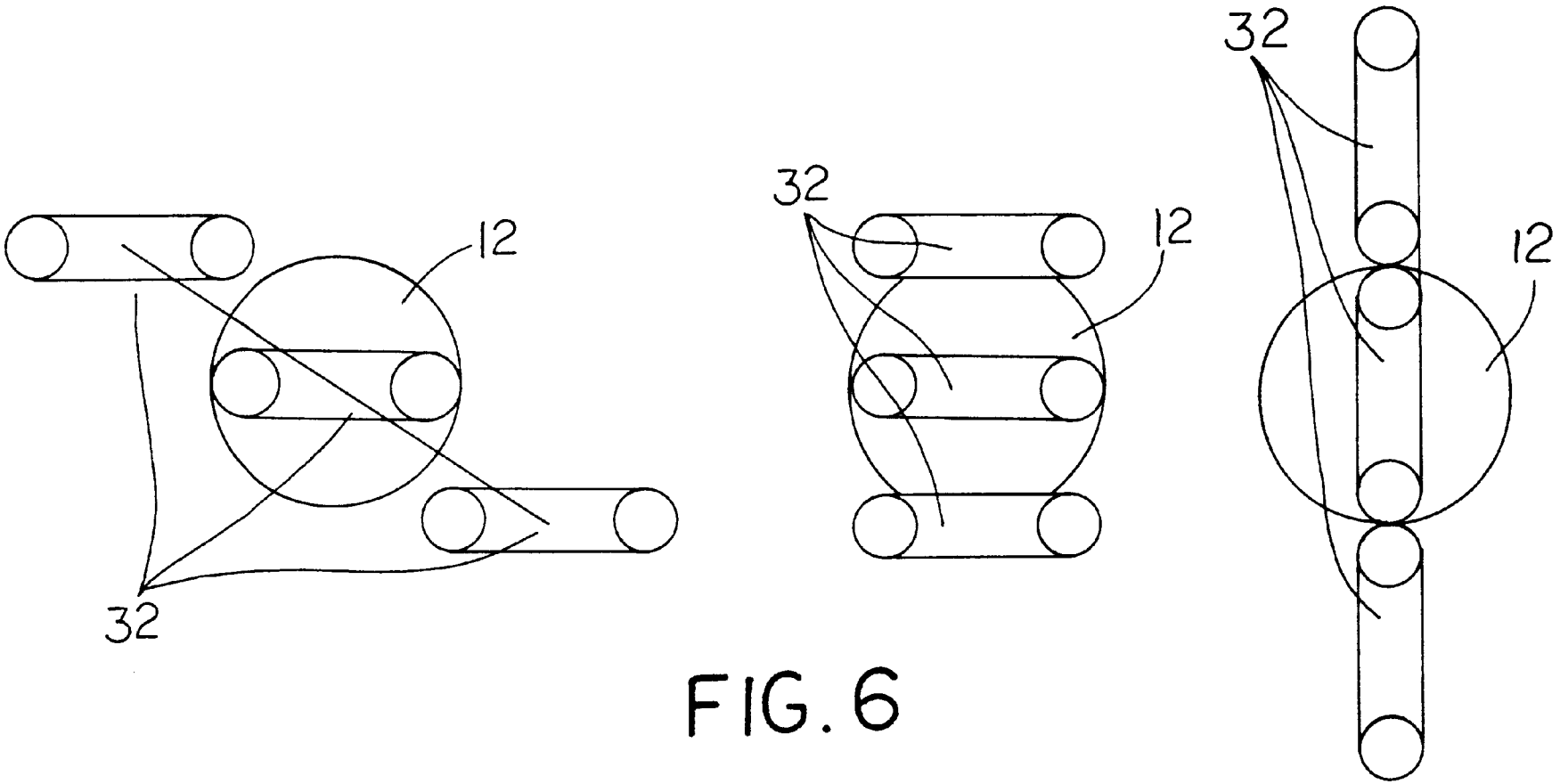
FIG. 6 is a diagrammatic side view of an alternative lift rotor assembly configuration.

Other alternative lift rotor assemblies are shown in FIGS. 5 and 6. Many shapes such as spherical, cylindrical, or rectangular and materials such as polystyrene foam, lightweight film, or lightweight fabric over a frame could be employed in the lift rotor assembly depending on the targeted rotational drag, stability, strength, weight and aesthetics. FIG. 5 is the side view of a quad cylinder lift rotor assembly. FIG. 6 shows the side view of a configuration of multiple double roller/belt rotors.

The preferred embodiment displayed in FIGS. 1 and 2 shows two cone shape lift rotor assemblies 32 flanking a single torque rotor assembly 12. The number of torque rotor assemblies and/or lift rotor assemblies or the aspect ratio of the rotor assemblies can be changed, giving glider 1 a modular quality that can be adapted to meet changing parameters.

Operation

FIGS. 1 to 6

The operation of the Multi-rotor kite glider is similar in operation to a standard kite. It flies in the air on the end of a line bridled in a manner to provide support across it's length. Like a simple rotor kite, it generates lift in accordance with the magnus effect by the rotational movement of it's horizontal spinning rotors.

In the preferred embodiment, FIGS. 1 and 2 blades 16 rotate when placed in an air stream and consequently turn the torque rotor assembly 12 in accordance with the magnus effect. In the alternative torque rotor assembly in FIG. 3, the rotor assembly turns because of the pressure differences created by the curved blades. In the torque rotor assembly in FIG. 4 rotation is created because of the pressure differences between the blades that are exposed to the air stream and those sheltered behind the wind screen. A hybrid torque rotor assembly could be employed utilizing elements of all three. A conventional propeller could also be employed.

As shown in FIGS. 1 and 2, the torque rotor assembly 12 is held securely by frame 10 but allowed to rotate easily in bearings 14. A power gathering system such as compressed air or electric would gather power from the torque rotor rotation in the wind. Solar panels could be used to supplement the wind power.

In the preferred embodiment, the torque rotor assembly 12 transfers torque to generator 26 via the torque rotor shaft 22 for the purpose of generating electric power. The generator shaft is mounted via a system of gears, sprocket/chain, or pulley/belt with the torque rotor shaft 22 while the generator shell is held secure by frame 10. The rotation of the torque rotor shaft 22 forces the rotation of the internal generator components, thus creating electricity.

Lift rotor shaft 30 is allowed to rotate in the frame through bearings 14. A transmission system using belts and pulleys, chains and sprockets, and/or gears with clutches or other similar means for power transfer, is used to transfer torque from the torque rotor shaft 22 to the lift rotor shaft 30. The preferred embodiment relies on a clutch whose housing is formed into a pulley. This torque is transferred from the torque rotor shaft 22 to the pulley shaped clutch housing 28 to the belt 25 to the rotor shaft pulley 29. This rotates the lift rotor shaft 30 and hence the lift rotor assemblies 32. The rotation of the lift rotor assemblies 32 causes lift in accordance with magnus effect.

The clutch 28, which could be magnetic or mechanical in nature, operates by an electric remote control. This clutch allows for control of the amount of rotation that is transferred from the torque rotor shaft 22 to the lift rotor assemblies 32. The ratio of rotational velocity is stepped up to create a high rate of velocity in the lift rotor assemblies 32, by manipulating the size and therefore the ratio between the clutch housing 28 and lift rotor shaft pulley 29.

Therein lies the key the operation of glider 1. The torque rotor assembly 12 rotates like a flywheel constantly creating electricity or compressed air to run the electric control components and available torque to turn the lift rotor assemblies via the pulley system. When the clutch is fully disengaged the lift rotor assemblies 32 does not turn at all creating a situation of zero lift. When the clutch is fully engaged, the lift rotor assemblies 32 turns at several times the speed of the torque rotor assembly thereby creating the enhanced lift potential of a high velocity system. The variable capacity of the clutch allows control of the velocity of the lift rotor assemblies 32 within this range. The glider 1 is in essence a wind engine which creates power through lift. Hence, the clutch is the "throttle" by which the power of this engine is controlled.

The preferred embodiment shows four servos 27 which could be used for various functions. The preferred embodiment shown in FIG. 1 utilizing a magnetic clutch would have an extra servo free for another function, while the clutch would be controlled by transistors. It is believed that the magnetic clutch could offer more precise variable control while eliminating the wear of mechanical clutch parts. These advantages would have to be considered against the increased weight and power requirements of the magnetic clutch. The mechanical clutch version would be controlled electronically by one of the servos 27.

The electronic nature of the glider 1 greatly enhances the options for control. The line configuration will vary depending on the extent of it's electronics and configuration of it's lift rotor assembly. With no electronic line control glider 1 could be controlled like a stunt kite with multiple strings. Servos 27 could be employed to move rudders 40 FIGS. 1 and 2, and/or vented or movable windscreens FIG. 4. In addition servos 27 could be used to electronically change the line length. In both instances glider 1 would have the control of a dual line stunt kite on a single line. On a single line glider 1 would not have the launch problems or the altitude limits of a multi-string kite.

If the lift rotor assemblies 32 had an asymmetrical aspect ratio as shown in FIGS. 5 and 6. Glider 1 would have quad line capabilities using servos 27 given a single line, or by using four lines. The high and low pressure zone would be focused on the long legs of the shapes. The lift rotor assembly could then be tipped like an airplane wing to direct the lift.

The preferred embodiment shows the lift rotor assemblies 32 on a single lift rotor shaft 30. In this manner both lift rotor assemblies 32 would rotate at identical velocity levels creating an inherent stability. Glider 1 could be made with the lift rotor assemblies 32 on separate shafts. Purposefully instigated variances in the rotational velocities between the lift rotor assemblies 32 would be another means of control. A more complex transmission could be added between the torque rotor shaft 22 and the lift rotor assemblies 32 to allow the lift rotor assemblies 32 to be reversed, thereby cause lift and, direction to be reversed for yet another control possibility.

The addition of a storage unit such as a battery for electricity and the magnetic clutch could be reprogrammed to serve as an auxiliary electric engine. Electric, compressed gas, spring actuated or combustion engines could be used to provide power for rotation to handle lulls in the wind.

The preferred embodiment incorporates the best and most likely of the advanced means of control, in a simple yet flexible package, that is relatively portable and easy to manufacture. Glider 1 is a remote control, multi-rotor kite, designed for the purpose of producing a variably controlled vector of lift, in order to perform practical tasks.

Summary, Ramifications, and Scope

The task for which glider 1 was created was as a means of power for sailing craft. In this role glider 1, on it's line or lines would be directed to the proper coordinates perpendicular, to the keel ion vehicle being propelled, by the use of the means for control of the glider 1 movement. Glider 1 would be directed, through the use of the means of control of the power transfer system to create a vector of force along it's line and therefore against the side of the keel of said craft. The sail craft would then derive movement in accordance with the principles of sail theory.

In addition glider 1 would bring a whole new dimension to the Art of sailing. Sailing craft of the past have been limited to the surfaces of the mediums they in which they traverse. Glider 1 allows for a break with this tradition in two ways. First, the variable distance between glider 1 and it's traction point, would allow a connection to an active sail to be maintain for a submerged craft. Submarines could become wind sailing vehicles. They're operation would be as described above except the keels could be moved to derive forward movement through a side force in any direction, rather than just starboard/port, within the limits imposed by the up wind limitations of sail theory. Second, glider 1 would allow a traction point to be maintained with the ground, while it lifted itself and it's pilot off the surface before a controlled break of that traction point would convert it to a glider.

As an engine glider 1 coupled with an appropriate multi-terrain anchor/keel/line/reel has the potential to travel almost any direction to almost any point on earth, including it's bodies of water or it's atmosphere, in almost any terrain on wind power alone.

Glider 1 usefulness extends past those that have been presented in it's role in sailing. It's ability to create a vector of power of a controllable magnitude, in a controllable direction would make very useful as a crane/winch system.

For a load that would be self securing, the line of glider 1 would be hooked at an appropriate point on the load. Glider 1 would be moved to the coordinates representing the desired vector and powered up or flexed to the desired power level. An example would be freeing a stuck automobile.

To move a unsecured load, the end of the glider 1 would be attached to a secure point on the earth. A hook would then be place at a appropriate point on the glider 1 line and glider 1 would again be flexed. The load would be lifted of the ground to the point between the traction point and glider 1 on the straightened line. Glider 1 could be moved in the sky thus moving the load, and then powered down or relaxed in a controlled fashion, thereby returning the load to earth at a different position. A winch governing the first glider or a second glider governing a movable load attachment point on the first glider's line would further enhance mobility of the load.

In addition since glider 1 produces electricity, it could be valuable in lifting electronic devices such as cameras, antennae, or lights. It's movement would give it the ability to place these devices into useful positions. Glider 1 would not only provide the electricity to power these devices, the extra available servos could be used to operate switches thereby controlling their functions remotely.

Finally, since glider 1 can be flexed or relaxed on demand it is in essence similar to a muscle. Hence Multiple glider could be flexed and relaxed in controlled synchronization to perform tasks.

For example by using a spring loaded pneumatic piston with it's housing secured and the piston end attached to the line of a glider, compressed air could be generated for power. The interplay between the spring forcing movement of the piston in the cylinder one way, and glider 1 forcing movement in opposition, would causes the accumulation of compressed air through a simple series of one way valves. Or, a large electric generator could be fitted with a large double armed balanced crank familiar in use on the common bicycle. By attaching two gliders, one on each arm of the crank, then alternatively flexing and relaxing each one, the generator could be turned in the same way a bicycle is pedaled, thereby creating electricity.

A wide variety of machinery could be powered using gliders as muscle like devices.

I claim:

1. A multi-rotor gyro kite comprising:

(a) lift means rotatable about a central longitudinal axis for generating vertical lift using the Magnus Effect and including at least one rotatable foil of predetermined shape and frictional coefficient, (b) torque means mounted adjacent the lift means and rotatable about a central lateral axis for generating rotational torque from air flow over the kite, the torque means including at least one blade having a predetermined curvature to produce reciprocal lift in an air stream and hence propel the torque means about its lateral axis, (c) transmission means connecting the lift means and torque means for transferring power from the torque means to the lift means at a variable and predetermined ratio, (d) first control means for operating the transmission means.

2. A multi-rotor gyro kite of claim 1 wherein the torque means includes pivotable blades with a predetermined curve to cause rotation, a retaining means to define an axis for said rotation, a bearing means to allow rotation of said blade about said axis.

3. A multi-rotor gyro kite of claim 1 wherein said lift rotor assembly comprises a center shaft to define an axis for said lift rotor assembly, at least one rib configured in an intersecting plane, a plurality of members attached to said shaft and ribs tensioned and configured to hold said shaft and ribs in relation to each other while defining the shape of said lift rotor assembly.

4. A multi-rotor gyro kite of claim 1 further including an electric generator means to provide power for remote electronic functions.

5. A multi-rotor gyro kite of claim 1 further including a second control means to control the attitude of the multi-rotor gyro kite.

6. A multi-rotor gyro kite comprising:

rotor lift means for generating vertical lift to elevate the engine, the rotor lift means including at least one pivotable foil means of predetermined shape and frictional coefficient for converting rotational movement into vertical movement to lift the engine, rotor torque means (12) for converting air flow around the engine into rotational torque used to power the lift assembly, said rotor torque means including at least one blade about a defined axis, with predetermined curvature for producing reciprocal lift and hence rotation around said axis in an air stream, and transmission means for transferring power generated from the rotor torque means to the rotor lift means at a predetermined ratio, wherein the rotor lift means further including a center shaft to define an axis for said lift rotor assembly, at least one rib configured in an intersecting plane, a plurality of members attached to said shaft and ribs tensioned and configured to hold said shaft and ribs in relation to each other while defining the shape of the rotor lift means.

7. A multi-rotor gyro kite comprising:

a) a rotor lift assembly including at least one pivotable foil means of predetermined shape and frictional coefficient to convert rotation into lift, b) a retaining means to define an axis for said rotation, c) a bearing means for allowing rotation of said foil about said axis, d) a transmission means for transferring power to said lift rotor assembly at a variable and predetermined ratio, e) a control means to operate said transmission means, f) a pivotable torque rotor assembly, including at least one blade about a defined axis, with predetermined curvature to produce reciprocal lift and hence rotation around said axis in an air stream, a retaining means to hold said blades in a predetermined configuration around said axis, a bearing means to allow rotation from lift of said blades of said lift rotor assembly around said axis when placed in a wind stream, to generate torque to provide power for said control means, and for rotational movement of said lift rotor assembly through said transmission means, wherein said lift rotor assembly comprises a center shaft to define an axis for said lift rotor assembly, at least one rib configured in an intersecting plane, a plurality of members attached to said shaft and ribs tensioned and configured to hold said shaft and ribs in relation to each other while defining the shape of said lift rotor assembly.

* * * * *